US010641264B2

(12) United States Patent
Engelmann et al.

(10) Patent No.: US 10,641,264 B2
(45) Date of Patent: May 5, 2020

(54) MODULAR THRUST-COMPENSATING ROTOR ASSEMBLY

(71) Applicant: CIRCOR Pumps North America, LLC, Monroe, NC (US)

(72) Inventors: Helmut Engelmann, Radolfzell (DE); Stefan Werner, Allensbach (DE); Yongchun Ma, Allweilerstrasse (DE); Jurgen Broders, Radolfzell (DE)

(73) Assignee: CIRCOR PUMPS NORTH AMERICA, LLC, Monroe, NC (US)

( * ) Notice: Subject to any disclaimer, the term of this patent is extended or adjusted under 35 U.S.C. 154(b) by 199 days.

(21) Appl. No.: 15/740,492

(22) PCT Filed: May 11, 2016

(86) PCT No.: PCT/US2016/031769
§ 371 (c)(1),
(2) Date: Dec. 28, 2017

(87) PCT Pub. No.: WO2017/189022
PCT Pub. Date: Nov. 2, 2017

(65) Prior Publication Data

US 2018/0187675 A1 Jul. 5, 2018

Related U.S. Application Data

(60) Provisional application No. 62/329,290, filed on Apr. 29, 2016.

(51) Int. Cl.
*F04C 2/16* (2006.01)
*F01C 21/02* (2006.01)
(Continued)

(52) U.S. Cl.
CPC ..... *F04C 2/165* (2013.01); *F01C 21/02* (2013.01); *F04C 14/28* (2013.01);
(Continued)

(58) Field of Classification Search
CPC .. F01C 21/02; F04C 2240/54; F04C 2240/56; F04C 2/165
See application file for complete search history.

(56) References Cited

U.S. PATENT DOCUMENTS 2,111,883 A * 3/1938 Burghauser ..... F04C 2/16 418/72
3,247,580 A 4/1966 Sennet
(Continued)

FOREIGN PATENT DOCUMENTS

DE 3010606 A1 10/1981
GB 476377 A 12/1937

OTHER PUBLICATIONS

International Preliminary Report on Patentability and Written Opinion for PCT/US2016/031769 dated Nov. 8, 2018, 6 pages.
(Continued)

*Primary Examiner* — Mary Davis

(57) ABSTRACT

A modular rotor assembly for a screw pump including a power rotor and an idler rotor having respective first ends adapted to be disposed in a suction side of the screw pump and respective second ends adapted to be disposed in a discharge side of the screw pump, the power rotor including a balance piston adapted to be disposed within a pump housing of the screw pump with a radial clearance between an entire circumference of the balance piston and the pump housing is in a range between 1 micron and 200 microns, wherein the power rotor is provided with a tapered bearing surface configured to define a wedge-shaped, radial gap axially intermediate the power rotor and the idler rotor.

19 Claims, 5 Drawing Sheets

(51) Int. Cl.
*F04C 15/00* (2006.01)
*F04C 14/28* (2006.01)

(52) U.S. Cl.
CPC ..... *F04C 15/0042* (2013.01); *F04C 2240/54* (2013.01); *F04C 2240/56* (2013.01)

(56) References Cited

U.S. PATENT DOCUMENTS

| | | | |
|---|---|---|---|
| 4,131,400 | A | 12/1978 | Segerstrom |
| 6,066,903 | A | 5/2000 | Ichiyama |
| 6,688,868 | B2 | 2/2004 | Segers et al. |
| 2010/0278671 | A1 | 11/2010 | Ghasripoor et al. |
| 2013/0052072 | A1 | 2/2013 | Smith et al. |

OTHER PUBLICATIONS

European Search Report and Written Opinion for the European Patent Application No. EP16900752, dated Dec. 18, 2019, 9 pages.

* cited by examiner (A from FIG. 1a)

*(A from FIG. 3a)*

MODULAR THRUST-COMPENSATING ROTOR ASSEMBLY

FIELD OF THE DISCLOSURE

Embodiments of the present invention relate generally to the field of fluid pumps, and more particularly to a modular, thrust-compensating rotor assembly for screw pumps.

BACKGROUND OF THE DISCLOSURE

A conventional screw pump typically includes an elongated pump cover having a fluid inlet located adjacent a first longitudinal end, or "suction side," thereof, and a fluid outlet located adjacent a second longitudinal end, or "discharge side," thereof. A rotatably driven screw, commonly referred to as a "power rotor," and two or more intermeshing, non-driven "idler rotors" extend through the pump cover and operate to entrain and drive fluid from the fluid inlet to the fluid outlet. An end of the power rotor on the discharge side terminates in a balance piston that separates the discharge side of the pump from a cavity at low pressure further downstream, typically serving as seal chamber and being connected with the suction side of the pump. In some configurations, the balance piston may abut and limit axial movement of the idler rotors. The power rotor extends through a ball bearing that supports the power rotor and allows the power rotor to rotate freely about its axis with minimal frictional resistance. Alternatively, a slide bearing may be implemented which also may incorporate the function of the balance piston.

During operation, the idler rotors of a screw pump may be subjected to significant hydraulic and frictional forces that require axial counter-balancing to hold the idler rotors in place. Various mechanical arrangements have been implemented for providing such counter-balancing. For example, in screw pumps having a "hanging idler" configuration, which is particularly suitable for handling low pressures and/or high viscosity fluids, the balance piston of the power rotor is radially flanked by low pressure chambers defined by downstream ends of idler rotor bores formed in the pump cover. These low pressure chambers are located immediately downstream from the downstream faces of the idler rotors and thus allow pumped fluid to flow downstream beyond the idler rotors with relatively little resistance. The back pressure at the downstream faces of the idler rotors is therefore relatively low, resulting in a relatively small net axial force on the idler rotors directed toward the discharge side. Since the net axial force is relatively small, axial engagement between the downstream faces of the idler rotors and the upstream face of the balance piston may be sufficient to counter-balance the axial force and stabilize the idler rotors. Additionally, other forces (e.g., gravity) that may act on the idler rotors during assembly and/or reorientation of the pump are relatively small in this configuration and may be counteracted by simple counter-balancing faces integrated into the pump cover to restrict axial movement of the idler rotors toward the suction side.

Thus, the hanging idler configuration is relatively inexpensive and can be readily implemented in a modular, easily removable rotor assembly, though such configuration is generally not suitable for handling high pressures and/or low viscosity fluids for which the leakage over the balance piston, acceptable in the hanging idler configuration and resulting in lower volumetric efficiency, may not be acceptable, and for which greater counter-balancing may be necessary.

For applications in which it is necessary to handle high pressures and/or low viscosity fluids, and/or if it is desirable to mitigate leakage of a pumped fluid, a screw pump having a "thrust face" configuration may be implemented. In contrast to the hanging idler configuration described above, the thrust face configuration employs an arrangement in which the entire circumference of the balance piston is surrounded by the pump cover in a radially close-clearance relationship (i.e., with no low pressure chambers flanking the balance piston as in the hanging idler configuration), thereby substantially preventing fluid leakage around the balance piston. This arrangement creates significant backpressure at the discharge side, resulting in a relatively large net axial force on the idler rotors directed toward the suction side. Since axial engagement between bearing surfaces of the power rotor and the idler rotors and/or between bearing surfaces of the pump cover and the idler rotors may not be sufficient to counter-balance the net axial force and stabilize the idler rotors, alternative counter-balancing structures at the upstream ends of the idler rotors on the suction side may be necessary. For example, the suction side of the pump cover may be provided with bearing surfaces, or "thrust faces," against which the upstream ends of the idler rotors may bear during operation. Thus, while the thrust face configuration provides reduced leakage relative to the hanging idler configuration, it does so at the expense of greater frictional losses resulting from engagement between the idler rotors and the thrust faces of the pump cover. Additionally, the structural elements necessary for implementing the thrust face configuration increase the cost and complexity of the configuration. Still further, if the thrust faces are incorporated into the pump cover, the thrust face configuration generally cannot be implemented in a modular, easily removable rotor assembly.

For applications in which it is necessary to handle high pressures and low viscosity fluids having poor lubrication properties, a screw pump having a "balance bushing" configuration may be implemented. The balance bushing configuration employs an arrangement in which an end of each idler rotor (typically the end on the suction side) is tapped and is surrounded by a bushing. Fluid lines that are internal or external to the pump cover are used to channel an amount of the pumped fluid from an opposing end of the idler rotors to the tapped ends via holes in the bushings, whereby the channeled fluid provides a counter-balancing, axial force on the idler rotors. Since the pressure of the pumped, low viscosity fluid is subject to dramatic variation, it is generally necessary to employ additional counter-balancing structures (e.g., thrust disc arrangements) on the opposite ends of the idler rotors (i.e., the ends of the idler rotors opposite the ends on which the balance bushings are disposed). These additional counter-balancing structures, along with the fluid lines that are necessary for channeling the pumped fluid to the balance bushings, make the balance bushing configuration the most complex and most expensive of the above described screw pump configurations. Additionally, if the balance bushings are disposed on the suction side of the screw pump, a modular, easily removable rotor assembly generally cannot be implemented.

In view of the foregoing, it would be advantageous to provide a modular, easily removable rotor assembly for screw pumps, wherein the rotor assembly is capable of handling high pressures and low viscosity fluids without requiring the costly and complex counter-balancing structures of conventional thrust face and balance bushing screw pump configurations.

SUMMARY OF THE DISCLOSURE

This Summary is provided to introduce a selection of concepts in a simplified form that are further described below in the Detailed Description. This Summary is not intended to identify key features or essential features of the claimed subject matter, nor is it intended as an aid in determining the scope of the claimed subject matter.

An exemplary embodiment of a screw pump in accordance with the present disclosure may include a power rotor and an idler rotor having respective first ends adapted to be disposed in a suction side of the screw pump and respective second ends adapted to be disposed in a discharge side of the screw pump, the power rotor including a balance piston enclosed by the pump housing, wherein a radial clearance between an entire circumference of the balance piston and the pump housing is in a range between 1 micron and 200 microns, wherein the power rotor is provided with a tapered bearing surface configured to define a wedge-shaped, radial gap axially intermediate the power rotor and the idler rotor.

An exemplary embodiment of a modular rotor assembly for a screw pump in accordance with the present disclosure may include a power rotor and an idler rotor having respective first ends adapted to be disposed in a suction side of the screw pump and respective second ends adapted to be disposed in a discharge side of the screw pump, the power rotor including a balance piston adapted to be disposed within a pump housing of the screw pump with a radial clearance between an entire circumference of the balance piston and the pump housing is in a range between 1 micron and 200 microns, wherein the power rotor is provided with a tapered bearing surface configured to define a wedge-shaped, radial gap axially intermediate the power rotor and the idler rotor.

BRIEF DESCRIPTION OF THE DRAWINGS

By way of example, specific embodiments of the disclosed device will now be described, with reference to the accompanying drawings, in which.

DETAILED DESCRIPTION

Figure 1A:
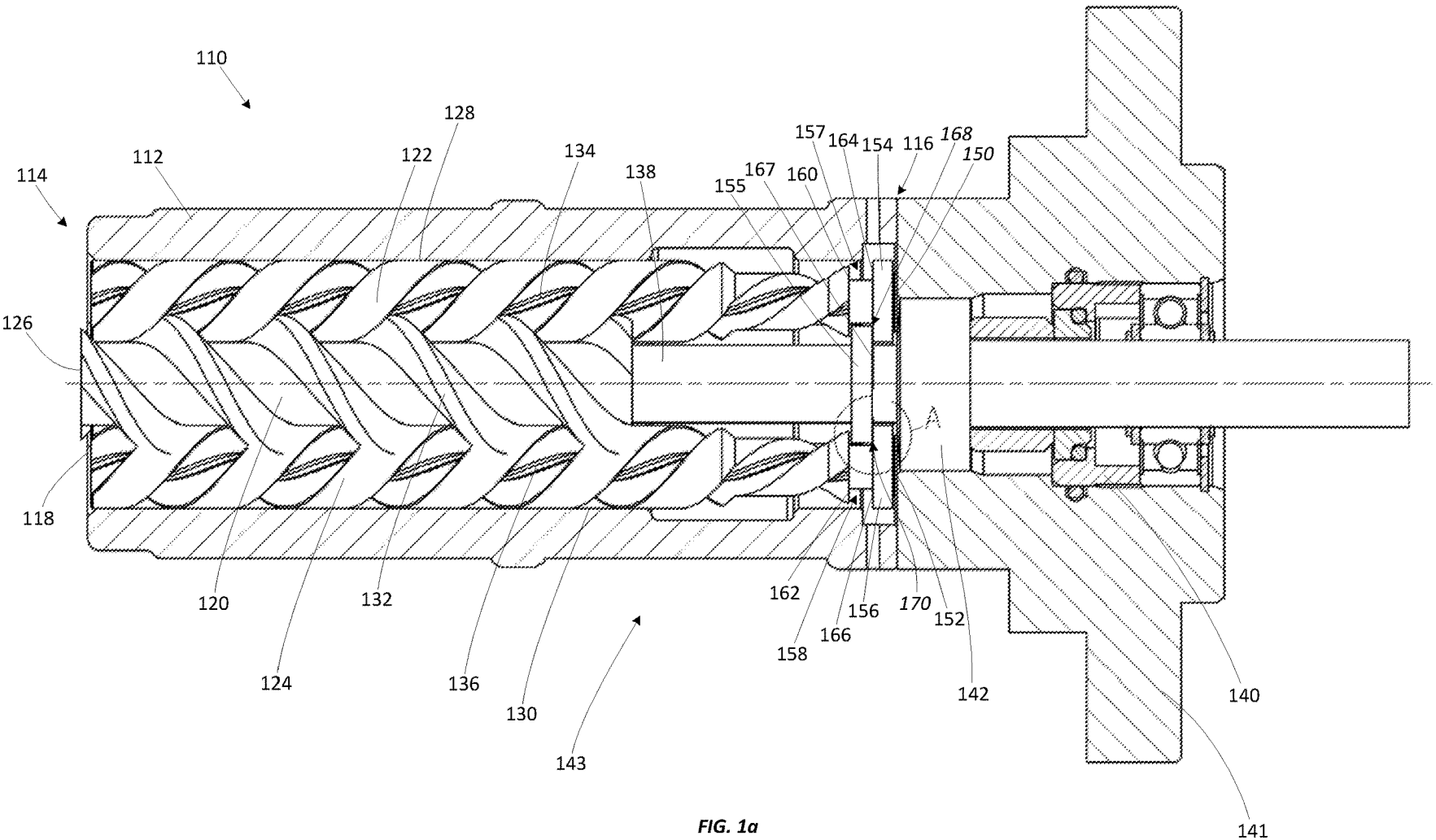
FIG. 1*a* is a top cross sectional view illustrating an exemplary embodiment of a fluid pump in accordance with the present disclosure.

A modular rotor assembly for a screw pump in accordance with the present disclosure will now be described more fully hereinafter with reference to the accompanying drawings, in which certain exemplary embodiments of the rotor assembly are presented. The rotor assembly may be embodied in many different forms and is not to be construed as being limited to the embodiments set forth herein. These embodiments are provided so that this disclosure will be thorough and complete, and will fully convey the scope of the rotor assembly to those skilled in the art. In the drawings, like numbers refer to like elements throughout unless otherwise noted.

FIG. 1*a* shows a sectional top view of a screw pump 110 (hereinafter "the pump 110") in accordance with an exemplary embodiment of the present disclosure. In various alternative embodiments of the present disclosure, the pump 110 may be implemented as a modular pump insert that may be removablely installed in a larger pump housing (not shown). For the sake of convenience and clarity, terms such as "radial," "longitudinal," "inward," "outward," "upstream," and "downstream" will be used herein to describe the relative positions and orientations of various components of the pump 110, all with respect to the geometry and orientation of the pump 110 as it appears in FIG. 1*a*. Particularly, the term "upstream" shall refer to a position nearer the left side of FIG. 1*a*, and the term "downstream" shall refer to a position nearer the right side of FIG. 1*a*. Similar terminology will be used in a similar manner to describe subsequent embodiments disclosed herein.

The pump 110 may include an elongated, substantially cylindrical pump casing 112 having a suction side 114 where fluid may enter the pump 110 and a discharge side 116 where fluid may exit the pump 110. In alternative embodiments in which the pump 110 is implemented as a pump insert as briefly discussed above, the pump casing 112 may instead be implemented as a pump liner adapted for installation within a larger pump housing (not shown). The pump casing 112 may house a modular rotor assembly 118 that includes a central power rotor 120 and two adjacent idler rotors 122, 124 that include respective threaded portions 126, 128, 130 having helical screw threads 132, 134, 136. The screw threads 134, 136 of the idler rotors 122, 124 may be disposed in a radially intermeshing relationship with the screw threads 132 of the power rotor 120. The power rotor 120 may include an integral drive shaft 138 that may be rotatably supported by a bearing assembly 140 within a pump cover 141 that is coupled to the pump casing 112. The pump casing 112 and the pump cover 141 will be collectively referred to as the pump housing 143. The drive shaft 138 may be coupled to a drive mechanism (not shown), such as an electric motor, for rotatably driving the power rotor 120 about its longitudinal axis during operation of the pump 110. The drive shaft 138 may include by an integral balance piston 142 at the discharge side 116 of the pump 110. The balance piston 142 may have a diameter that is larger than a diameter of the drive shaft 138 and may be substantially surrounded by the pump housing 143 in a radially close clearance relationship therewith as further described below.

The power rotor 120 may be provided with a thrust disc 155 that extends radially outwardly from the drive shaft 138 upstream of the balance piston 142. The thrust disc 155 may extend into engagement with complimentary annular thrust grooves 157, 158 formed in the idler rotors 122, 124. The thrust grooves 157, 158 may be axially bounded by downstream faces 160, 162 of the threaded portions 128, 130 and by upstream faces 164, 166 of the flanged ends 154, 156 of the respective idler rotors 122, 124. The engagement between the thrust disc 155 and the thrust grooves 157, 158 may aid in the radial and/or axial positioning and support of the idler rotors 122, 124.

Figure 1B:
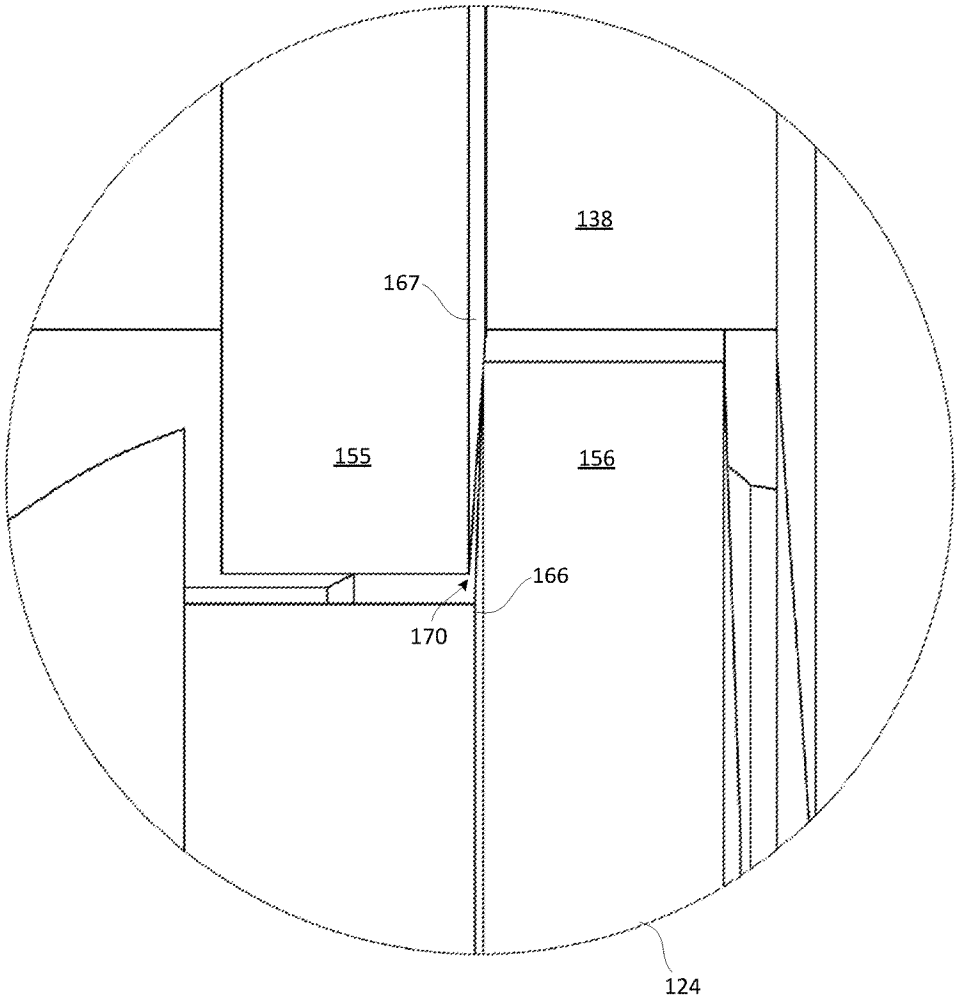
FIG. 1*b* is a detailed view illustrating the area A in FIG. 1*a;*

The downstream face 167 of the thrust disc 155 may be slightly sloped or convex (hereinafter collectively referred to as "tapered"). For example, the downstream face 167 may be tapered with an angle of −2 to 2 degrees with respect to vertical as shown in FIG. 1*b* (the slope of the downstream face 167 is exaggerated for clarity). Similarly, the upstream faces 164, 166 of the flanged ends 154, 156 of the idler rotors 122, 124 may be slightly tapered as best shown in FIG. 1*b* (the upstream face 164 of the flanged end 154 is not shown in FIG. 1*b* but is substantially identical to the upstream face 166 of the flanged end 156). Thus, the confronting upstream faces 164, 166 of the flanged ends 154, 156 of the idler rotors 122, 124 and the downstream face 167 of the thrust disc 155 may define respective wedge-shaped, radial gaps 168, 170 there between that may facilitate the creation of hydrodynamic bearings intermediate the faces 164 and 167 and intermediate the faces 166 and 167 as will be described in greater detail below.

As shown in FIG. 1*b*, the taper of the downstream face 167 of the thrust disc 155 may be greater than the taper of the upstream face 166 of the flanged end 156. This may ensure that any contact between the downstream face 167 of the thrust disc 155 and the upstream face 166 of the flanged end 156 is limited to a portion of the downstream face 167 radially distant from the drive shaft 138 and to a portion of upstream face 166 immediately adjacent the outer diameter of the flanged end 156. This may mitigate undesirable sliding and scuffing of portions of the power rotor 120 and idler rotor 124 adjacent the downstream face 167 and upstream face 166.

During operation of the pump 110, the power rotor 120 may be rotatably driven (e.g., by an electric motor via the drive shaft 138), which may in-turn rotatably drive the idler rotors 122, 124 about their axes via engagement between the intermeshing screw threads 132, 134, 136. Fluid entering the suction side 114 of the pump 110 may be entrained within fluid chambers that are bounded by the intermeshing screw threads 132, 134, 136 and the interior surface of the pump casing 112. Continued rotation of the power rotor 120 and the idler rotors 122, 124 may cause the fluid chambers and the fluid contained therein to move from the upstream end of the pump 110 toward the downstream end of the pump 110 where the fluid may be forced out of the discharge side 116 through a fluid outlet (not shown) in the pump housing 143.

The balance piston 142 may be fully surrounded by the pump housing 143 and may have a diameter that is nearly equal to, but slightly smaller, than the inner diameter of the surrounding pump housing 143. For example, a radial clearance between an entire circumference of the balance piston 142 and the pump housing 143 may be in a range between 1 micron and 200 microns. Thus, the radial gap between the balance piston 142 and the pump housing 143 may be large enough to allow rotation of the balance piston 142 within the pump housing 143 without interference, but small enough to substantially prevent fluid from leaking around the balance piston 142.

Owing to the absence of a significant leakage path downstream of the idler rotors 122, 124, the idler rotors 122, 124 are subjected to significant backpressure at the juncture between the downstream faces 150, 152 of the flanged ends 154, 156 and the balance piston 142. The backpressure at the discharge side 116 may be greater than the fluid pressure at the suction side 114, and the magnitude of the upstream-directed axial forces acting on the idler rotors 122, 124 may be greater than the magnitude of the downstream-directed axial forces acting on the idler rotors 122, 124. Thus, the net result of these various forces may be an upstream-directed axial force acting on the idler rotors 122, 124 that may push the idler rotors 122, 124 in the upstream direction toward the suction side as shown in FIG. 1*a*.

The wedge-shaped, radial gaps 168, 170 defined by the confronting tapered upstream faces 164, 166 of the flanged ends 154, 156 of the idler rotors 122, 124 and the tapered downstream face 167 of the thrust disc 155 may allow pressurized fluid to form a lubricating, hydrodynamic fluid film there between. Thus, axial engagement between the faces 164 and 167 and between the faces 166 and 167 may partially or entirely prevented during operation of the pump 110.

The configuration of the rotor assembly 118, and particularly the tapered downstream face 167 of the thrust disc 155 and, optionally, the tapered upstream faces 164, 166 of the flanged ends 154, 156 of the idler rotors 122, 124, may provide a reduction in frictional losses and mechanical wear at the junctures of the faces 164, 166, and 167 and may increase the axial load capacity of the rotor assembly 118 relative to conventional rotor assemblies employed in similarly sized screw pumps having thrust face configurations. Particularly, the additional axial load capacity provided by the flow of fluid between the faces 164 and 167 and between the faces 166 and 167 may be sufficient to counter-balance the entire upstream-directed axial forced acting on the idler rotors 122, 124. The pump 110 may therefore be implemented without any additional bearing surfaces or counter-balancing structures (e.g., thrust faces) at the suction side 114 of the pump 110 as are necessary in screw pumps having conventional thrust face configurations. Thus, the rotor assembly 118 may be easily and conveniently removed from the pump 110 and replaced without requiring extensive disassembly of the pump 110 or removal of the pump 110 from a pipeline.

An embodiment of the rotor assembly 118 is contemplated in which, in addition to the upstream faces 164, 166 of the flanged ends 154, 156 of the idler rotors 122, 124 being slightly tapered, the downstream faces 150, 152 of the flanged ends 154, 156 are also slightly tapered. The idler rotors of such an embodiment could therefore serve as "universal" idler rotors that could be implemented in various types of screw pumps to counter-balance axial forces in both the upstream direction and the downstream direction without requiring any additional counter-balancing structures.

Figure 2:
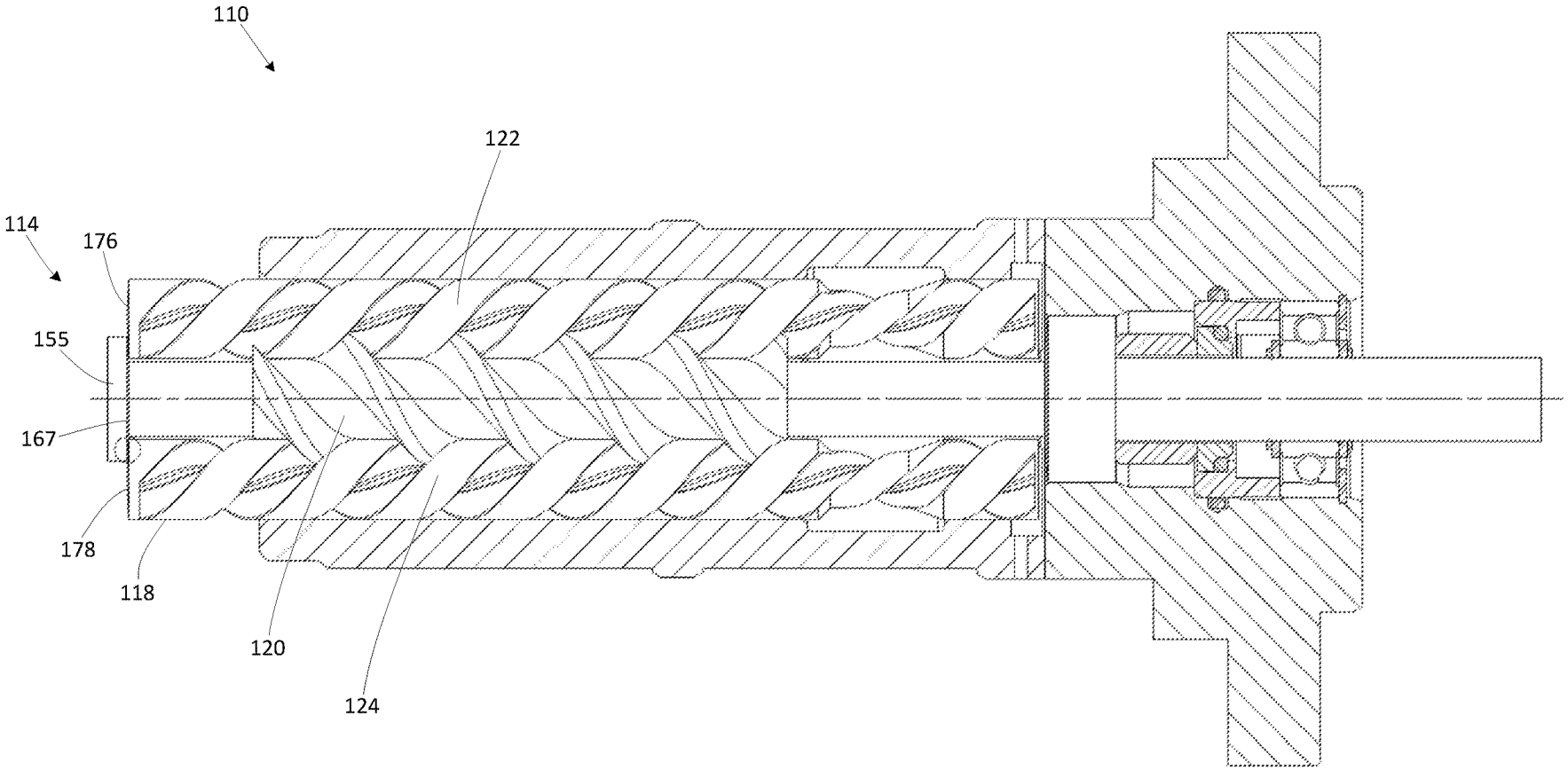
FIG. 2 is a top cross sectional view illustrating another exemplary embodiment of a fluid pump in accordance with the present disclosure.

Referring to FIG. 2, another embodiment of the rotor assembly 118 is contemplated in which the thrust disc 155 may extend radially outwardly from the power rotor 120 at the suction side 114 of the pump 110 (i.e., instead at the discharge side of the pump 110 as in FIGS. 1*a-b*) at a position upstream of, an in axial abutment with, the upstream ends 176, 178 of the idler rotors 122, 124. In such a configuration, the downstream face 167 of the thrust disc 155 and, optionally, the upstream ends 176, 178 of the idler rotors 122, 124 may be tapered, thereby forming hydrodynamic bearings axially intermediate the downstream face 167 of the thrust disc 155 and the upstream ends 176, 178 of the idler rotors 122, 124 and providing improved axial load capacity as described above. Notably, the idler rotors 122, 124 of this embodiment may be implemented without the annular thrust grooves 157, 158 of the embodiment depicted in FIGS. 1*a-b*.

Figure 3A:
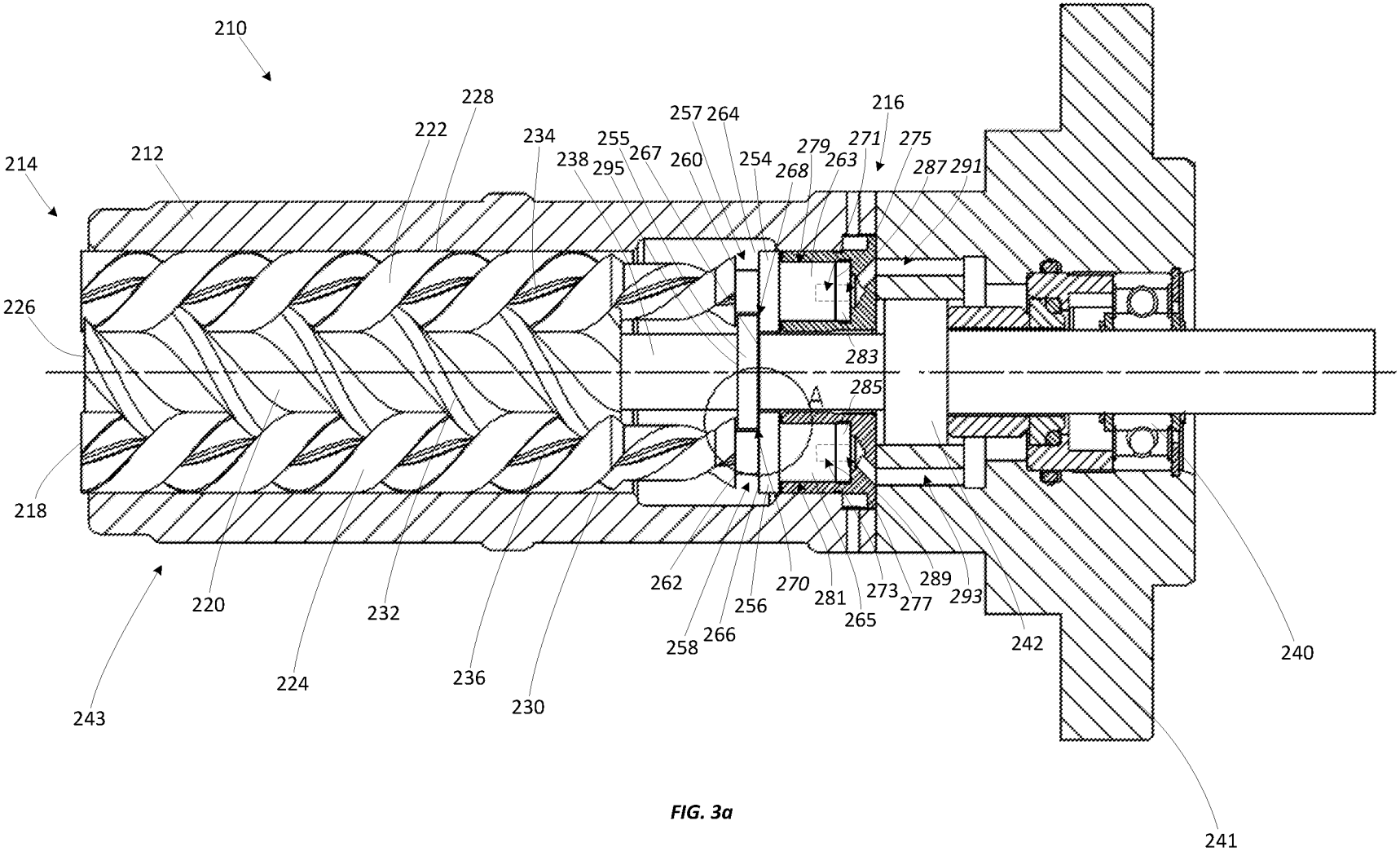
FIG. 3*a* is a top cross sectional view illustrating another exemplary embodiment of a fluid pump in accordance with the present disclosure.

FIG. 3*a* shows a sectional top view of a screw pump 210 (hereinafter "the pump 210") in accordance with another exemplary embodiment of the present disclosure. In various alternative embodiments of the present disclosure, the pump 210 may be implemented as a modular pump insert that may be removable installed in a larger pump housing (now shown). The pump 210 may be similar to the pump 110 described above and may include an elongated, substantially cylindrical pump casing 212 (or liner) having a suction side 214 where fluid may enter the pump 210 and a discharge side 216 where fluid may exit the pump 210. The pump casing 212 may house a modular rotor assembly 218 that includes a central power rotor 220 and two adjacent idler rotors 222, 224 that include respective threaded portions 226, 228, 230 having helical screw threads 232, 234, 236.

The screw threads 234, 236 of the idler rotors 222, 224 may be disposed in a radially intermeshing relationship with the screw threads 232 of the power rotor 220.

The power rotor 220 may include an integral drive shaft 238 that may be rotatably supported by a bearing assembly 240 within a pump cover 241 that is coupled to the pump casing 212. The pump casing 212 and the pump cover 241 will be collectively referred to as the pump housing 243. The drive shaft 238 may be coupled to a drive mechanism (not shown), such as an electric motor, for rotatably driving the power rotor 220 about its longitudinal axis during operation of the pump 210. The drive shaft 238 may include by an integral balance piston 242 at the discharge side 216 of the pump 210. The balance piston 242 may have a diameter that is larger than the diameter of the drive shaft 238 and may be substantially surrounded by the pump housing 243 in a radially close clearance relationship therewith as further described below.

The power rotor 220 may be provided with a thrust disc 255 that extends radially outwardly from the drive shaft 238 upstream of the balance piston 242. The thrust disc 255 may extend into engagement with complimentary annular thrust grooves 257, 258 formed in the idler rotors 222, 224. The thrust grooves 257, 258 may be axially bounded by downstream faces 260, 262 of the threaded portions 228, 230 and by upstream faces 264, 266 of flanged ends 254, 256 of the respective idler rotors 222, 224. The engagement between the thrust disc 255 and the thrust grooves 257, 258 may aid in the radial and/or axial positioning and support of the idler rotors 222, 224.

The idler rotors 222, 224 may include respective tapped ends 263, 265 that extend downstream from the flanged ends 254, 256 and that have axial cavities 271, 273 formed in their downstream faces 275, 277. Similar to screw pumps having conventional balance bushing configurations, the tapped ends 263, 265 may be disposed within respective axial recesses 279, 281 formed in the pump casing 212, with the downstream faces 275, 277 confronting respective balance bushings 283, 285. The balance bushings 283, 285 may define respective axial passageways 287, 289 that may be coupled to respective fluid conduits 291, 293 formed in the pump cover 241. The conduits 291, 293 facilitate pressure compensation between the suction side 214 of the pump 210 and the axial cavities 271, 273 of the idler rotors 222, 224, thereby relieving discharge pressure on the idler rotors 222, 224 The balance bushings 283, 285 may channel the pressurized fluid into the axial cavities 271, 273 of the tapped ends 263, 265, thereby subjecting the idler rotors 222, 224 to upstream-directed axial forces for providing axial counter-balancing of the idler rotors 222, 224 as will be described in greater detail below.

Figure 3B:
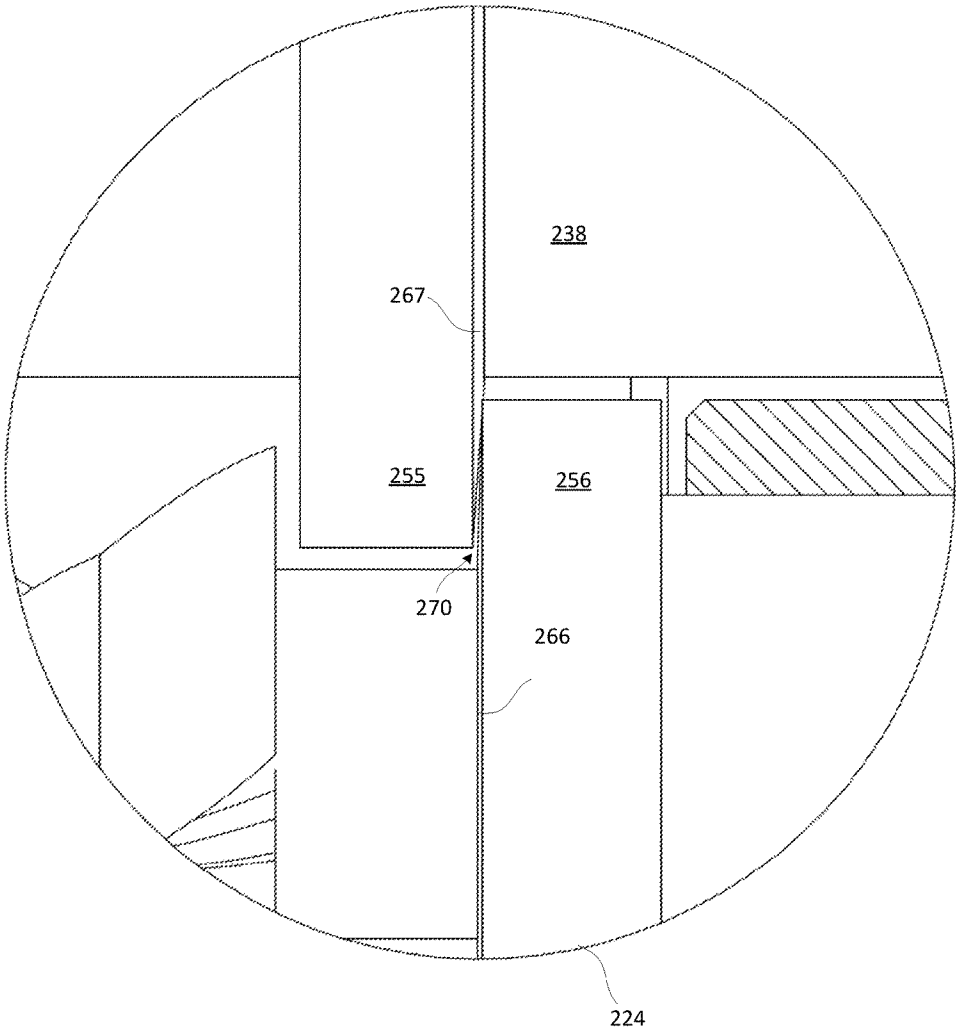
FIG. 3*b* is a detailed view illustrating the area A in FIG. 3*a*.

The upstream faces 264, 266 of the flanged ends 254, 256 of the idler rotors 222, 224 may be slightly tapered (e.g., from −2 to 2 degrees with respect to vertical) as best shown in FIG. 3*b* (the upstream face 264 of the flanged end 254 is not shown in FIG. 3*b* but is substantially identical to the downstream face 266 of the flanged end 256). Thus, the confronting upstream faces 264, 266 of the flanged ends 254, 256 of the idler rotors 222, 224 and the downstream face 267 of the thrust disc 255 may define respective, wedge-shaped, radial gaps 268, 270 there between that may facilitate the creation of hydrodynamic bearings intermediate the faces 264 and 267 and intermediate the faces 266 and 267 as will be described in greater detail below.

As shown in FIG. 3*b*, the taper of the downstream face 267 of the thrust disc 255 may be greater than the taper of the upstream face 266 of the flanged end 256. This may ensure that any contact between the downstream face 267 of the thrust disc 255 and the upstream face 266 of the flanged end 256 is limited to a portion of the downstream face 267 radially distant from the drive shaft 238 and to a portion of upstream face 266 immediately adjacent the outer diameter of the flanged end 256. This may mitigate undesirable sliding and scuffing of portions of the power rotor 220 and idler rotor 224 adjacent the downstream face 267 and upstream face 266.

During operation of the pump 210, the power rotor 220 may be rotatably driven (e.g., by an electric motor via the drive shaft 238), which may in-turn rotatably drive the idler rotors 222, 224 about their axes via engagement between the intermeshing screw threads 232, 234, 236. Fluid entering the suction side 214 of the pump 210 may be entrained within fluid chambers that are bounded by the intermeshing screw threads 232, 234, 236 and the interior surface of the pump casing 212. Continued rotation of the power rotor 220 and the idler rotors 222, 224 may cause the fluid chambers and the fluid contained therein to move from the upstream end of the pump 210 toward the downstream end of the pump 210 where the fluid may be forced out of the discharge side 216 through a fluid outlet (not shown) in the pump casing 212.

The balance piston 242 may be fully surrounded by the pump housing 243 and may have a diameter that is nearly equal to, but slightly smaller than, the inner diameter of the surrounding pump housing 243. For example, a radial clearance between an entire circumference of the balance piston 242 and the pump housing 243 may be in a range between 1 micron and 200 microns. Thus, the radial gap between the balance piston 242 and the pump housing 243 may be large enough to allow rotation of the balance piston 242 within the pump housing 243 without interference, but small enough to substantially prevent fluid from leaking around the balance piston 242.

The pressure of fluid entering the suction side 214 of the pump 210 may exert axial forces directed toward the discharge side 216 of the pump 210 on the idler rotors 222, 224. These forces may be counter-balanced by opposing axial forces exerted by fluid pressure at the tapped ends 263, 265 of the idler rotors 222, 224 where fluid is channeled via the balance bushings 283, 285 and the fluid conduits 291, 293 as described above. Generally, the fluid pressure at the tapped ends 263, 265 may be greater than the fluid pressure at the suction side 214, and the magnitude of the upstream-directed axial forces acting on the idler rotors 222, 224 may be greater than the magnitude of the downstream-directed axial forces acting on the idler rotors 222, 224. Thus, the net result of these various forces may be an upstream-directed axial force acting on the idler rotors 222, 224 that may push the idler rotors 222, 224 in the upstream direction toward the suction side as shown in FIG. 3*a*.

The wedge-shaped, radial gaps 268, 270 defined by the confronting, tapered upstream faces 264, 266 of the flanged ends 254, 256 of the idler rotors 222, 224 and the sloped downstream face 267 of the thrust disc 255 may allow pressurized fluid to form a lubricating, hydrodynamic fluid film there between. This may mitigate undesirable sliding and scuffing of portions of the power rotor 220 and idler rotor 224 adjacent the downstream face 267 and upstream face 266.

The configuration of the rotor assembly 218, and particularly the tapered upstream faces 264, 266 of the flanged ends 254, 256 of the idler rotors 222, 224 and the tapered upstream face 267 of the thrust disc 255, may provide a reduction in frictional losses and mechanical wear at the junctures of the faces 264, 266, and 267 and may increase the axial load capacity of the rotor assembly 218 relative to conventional rotor assemblies employed in similarly sized screw pumps having thrust face configurations. Particularly, the additional axial load capacity provided by the flow of fluid between the faces 264 and 267 and between the faces 266 and 267 may be sufficient to counter-balance the entire upstream-directed axial forced acting on the idler rotors 222, 224. The pump 210 may therefore be implemented without any additional bearing surfaces or counter-balancing structures at the suction side 214 of the pump 210 as are necessary in many screw pumps having conventional balance bushing configurations. Thus, the rotor assembly 218 may be easily and conveniently removed from the pump 210 and replaced without requiring extensive disassembly of the pump 210 or removal of the pump 210 from a pipeline.

An embodiment of the rotor assembly 218 is contemplated in which, in addition to the downstream face 267 of the thrust disc 255 being slightly tapered and, optionally, the upstream faces 264, 266 of the flanged ends 254, 256 of the idler rotors 222, 224 being slightly tapered, the upstream face 295 of the thrust disc 255 is also slightly tapered and, optionally, the downstream faces 260, 262 of the threaded portions 228, 230 of the idler rotors 222, 224 are also slightly tapered, thereby facilitating the creation of hydrodynamic bearings axially intermediate the faces 260 and 295 and axially intermediate the faces 262 and 295. Such a rotor assembly would be able to provide axial counter-balancing in both the upstream direction and the downstream direction without requiring any additional counter-balancing structures.

An embodiment of the rotor assembly 218 is contemplated in which, in addition to the downstream face 267 of the thrust disc 255 being slightly tapered and, optionally, the upstream faces 264, 266 of the flanged ends 254, 256 of the idler rotors 222, 224 being slightly tapered, the upstream face 295 of the thrust disc 255 is also slightly tapered. Optionally, the downstream faces 275, 277 of the idler rotors 222, 224 may also be slightly tapered, thereby facilitating the buildup of lubricating, hydrodynamic fluid films axially intermediate the faces 275, 277 and the balance bushings 283, 285.

The present disclosure is not to be limited in scope by the specific embodiments described herein. Indeed, other various embodiments of and modifications to the present disclosure, in addition to those described herein, will be apparent to those of ordinary skill in the art from the foregoing description and accompanying drawings. These other embodiments and modifications are intended to fall within the scope of the present disclosure. Furthermore, although the present disclosure has been described herein in the context of a particular implementation in a particular environment for a particular purpose, those of ordinary skill in the art will recognize that its usefulness is not limited thereto and that the present disclosure may be beneficially implemented in any number of environments for any number of purposes. Accordingly, the claims set forth below should be construed in view of the full breadth and spirit of the present disclosure as described herein. As used herein, an element or step recited in the singular and proceeded with the word "a" or "an" should be understood as not excluding plural elements or steps, unless such exclusion is explicitly recited. Furthermore, references to "one embodiment" of the present disclosure are not intended to be interpreted as excluding the existence of additional embodiments that also incorporate the recited features.

The invention claimed is:

1. A screw pump comprising:

a pump housing; and a rotor set disposed within the pump housing, the rotor set including a power rotor and an idler rotor having radially intermeshing threaded portions, the power rotor including a balance piston enclosed by the pump housing, wherein a radial clearance between an entire circumference of the balance piston and the pump housing is in a range between 1 micron and 200 microns;

wherein the power rotor is provided with a tapered bearing surface configured to define a wedge-shaped, radial gap axially intermediate the power rotor and the idler rotor.

2. The screw pump of claim 1, wherein the tapered bearing surface is a downstream face of a thrust disc that extends radially from the power rotor.

3. The screw pump of claim 2, wherein the tapered bearing surface of the thrust disc confronts a tapered bearing surface defined by an upstream face of the idler rotor.

4. The screw pump of claim 3, wherein an angle of the tapered bearing surface of the thrust disc is greater than the angle of the tapered bearing surface of the idler rotor.

5. The screw pump of claim 1, further comprising a thrust disc extending radially from the power rotor into an annular groove in the idler rotor, wherein the annular groove is bounded by a downstream face of the threaded portion of the idler rotor and an upstream face of a flanged end of the idler rotor, and wherein at least one of the downstream face of the threaded portion, the upstream face of the flanged end, a downstream face of the thrust disc, and an upstream face of the thrust disc is tapered for defining a wedge-shaped, radial gap axially intermediate the power rotor and the idler rotor.

6. The screw pump of claim 5, wherein the thrust disc and the annular groove are located at a discharge side of the screw pump.

7. The screw pump of claim 1, wherein the tapered bearing surface is a downstream face of a thrust disc that extends radially from the power rotor at a suction side of the screw pump.

8. The screw pump of claim 1, the idler rotor having a tapped end extending into a complementary recess in a discharge side of the pump housing, the tapped end having a cavity formed in a downstream face thereof.

9. The screw pump of claim 8, further comprising a balance bushing disposed within the recess and confronting the tapped end for channeling fluid into the cavity.

10. The screw pump of claim 1, wherein the tapered bearing surface is an upstream face of a thrust disc that extends radially from the power rotor at a discharge side of the screw pump.

11. A rotor set for a screw pump, the rotor set comprising:

a power rotor and an idler rotor having respective first ends adapted to be disposed in a suction side of the screw pump and respective second ends adapted to be disposed in a discharge side of the screw pump, the power rotor including a balance piston adapted to be disposed within a pump housing of the screw pump with a radial clearance between an entire circumference of the balance piston and the pump housing is in a range between 1 micron and 200 microns;

wherein the power rotor is provided with a tapered bearing surface configured to define a wedge-shaped, radial gap axially intermediate the power rotor and the idler rotor.

12. The rotor set of claim 11, wherein the tapered bearing surface is a downstream face of a thrust disc that extends radially from the power rotor.

13. The rotor set of claim 12, wherein the tapered bearing surface of the thrust disc confronts a tapered bearing surface defined by an upstream face of the idler rotor.

14. The rotor set of claim 13, wherein an angle of the tapered bearing surface of the thrust disc is greater than the angle of the tapered bearing surface of the idler rotor.

15. The rotor set of claim 11, further comprising a thrust disc extending radially from the power rotor into an annular groove in the idler rotor, wherein the annular groove is bounded by a downstream face of a threaded portion of the idler rotor and an upstream face of a flange at the second end of the idler rotor, and wherein at least one of the downstream face of the threaded portion, the upstream face of the flange, a downstream face of the thrust disc, and an upstream face of the thrust disc is tapered for defining a wedge-shaped, radial gap axially intermediate the power rotor and the idler rotor.

16. The rotor set of claim 15, wherein the thrust disc and the annular groove are located at the second end of the power rotor and the second end of the idler rotor, respectively.

17. The rotor set of claim 11, wherein the tapered bearing surface is a downstream face of a thrust disc that extends radially from the first end of the power rotor.

18. The rotor set of claim 11, wherein the second end of the idler rotor is tapped with a cavity formed in a downstream face thereof.

19. The rotor set of claim 11, wherein the tapered bearing surface is an upstream face of a thrust disc that extends radially from the second end of the power rotor.

* * * * *